US006089963A

United States Patent [19]

Wiand et al.

[11] Patent Number: 6,089,963

[45] Date of Patent: Jul. 18, 2000

[54] ATTACHMENT SYSTEM FOR LENS SURFACING PAD

[75] Inventors: Ronald C. Wiand, Troy; Richard J. Emmerling, Warren, both of Mich.

[73] Assignee: Inland Diamond Products Company, Madison Heights, Mich.

[21] Appl. No.: 09/272,229

[22] Filed: Mar. 18, 1999

[51] Int. Cl.[7] ..... B24B 13/02

[52] U.S. Cl. ..... 451/390; 451/921; 451/494

[58] Field of Search ..... 451/494, 526, 451/533, 538, 921

[56] References Cited

U.S. PATENT DOCUMENTS

| | | | |
|---|---|---|---|
| 3,236,010 | 2/1966 | Evans et al. | 451/921 X |
| 3,583,111 | 6/1971 | Volk | 451/921 X |
| 3,959,935 | 6/1976 | Stoppacher | 451/921 X |
| 4,131,436 | 12/1978 | Wiand . | |
| 4,274,232 | 6/1981 | Wylde | 451/921 X |
| 4,288,233 | 9/1981 | Wiand . | |
| 4,291,508 | 9/1981 | Prunier | 451/538 X |
| 4,613,437 | 9/1986 | Wiand . | |
| 4,733,502 | 3/1988 | Braun | 451/538 X |
| 4,776,862 | 10/1988 | Wiand . | |
| 4,908,046 | 3/1990 | Wiand . | |
| 4,914,865 | 4/1990 | Wiand et al. . | |
| 4,931,069 | 6/1990 | Wiand . | |
| 4,945,686 | 8/1990 | Wiand . | |
| 4,962,618 | 10/1990 | Wylde | 451/921 X |
| 4,968,326 | 11/1990 | Wiand . | |
| 5,022,895 | 6/1991 | Wiand . | |
| 5,052,153 | 10/1991 | Wiand . | |
| 5,095,660 | 3/1992 | Dillon | 451/921 X |
| 5,100,045 | 3/1992 | Wiand . | |
| 5,123,958 | 6/1992 | Wiand . | |
| 5,131,924 | 7/1992 | Wiand . | |
| 5,133,782 | 7/1992 | Wiand . | |
| 5,170,595 | 12/1992 | Wiand . | |
| 5,174,795 | 12/1992 | Wiand . | |
| 5,197,233 | 3/1993 | Wiand . | |
| 5,197,249 | 3/1993 | Wiand . | |
| 5,203,881 | 4/1993 | Wiand . | |
| 5,209,760 | 5/1993 | Wiand . | |
| 5,232,470 | 8/1993 | Wiand . | |
| 5,259,148 | 11/1993 | Wiand . | |
| 5,281,244 | 1/1994 | Wiand . | |
| 5,384,987 | 1/1995 | Wiand . | |
| 5,384,988 | 1/1995 | Hernandez | 451/538 X |
| 5,449,388 | 9/1995 | Wiand . | |
| 5,454,751 | 10/1995 | Wiand . | |
| 5,605,501 | 2/1997 | Wiand . | |
| 5,607,488 | 3/1997 | Wiand . | |
| 5,632,790 | 5/1997 | Wiand . | |
| 5,656,045 | 8/1997 | Wiand . | |
| 5,681,362 | 10/1997 | Wiand . | |

*Primary Examiner*—David A. Scherbel
*Assistant Examiner*—Anthony Ojini
*Attorney, Agent, or Firm*—Harness, Dickey & Pierce, P.L.C.

[57] ABSTRACT

An attachment system for a lens surfacing and polishing pad adapted for use with a lapping tool is described. The lapping tool includes a curved surface having a metallic surface disposed on at least a portion thereof. The pad has a configuration conforming to the curved surface of the lapping tool and includes a first abrasive surface and a second metallic surface. The metallic surface of the lapping tool may be magnetized, either selectively or permanently, permitting the metallic substrate surface to adhere thereto, thus removably fastening the pad to the lapping tool. Alternatively, the metallic surface of the pad may be magnetized, permitting the metallic surface of the lapping tool to adhere thereto, thus removably fastening the pad to the lapping tool.

74 Claims, 5 Drawing Sheets

ATTACHMENT SYSTEM FOR LENS SURFACING PAD

BACKGROUND OF THE INVENTION

1. Technical Field

The present invention relates generally to surfacing pads and, in particular, to pads used in conjunction with lens lapping tools for creating optical and ophthalmic lenses. More specifically, the present invention relates to an attachment system for attaching optical and ophthalmic lens surfacing pads to lens lapping tools.

2. Discussion

Optical and ophthalmic lenses are generally made by generating a lens blank to the approximate curvature on a lens generator and then surfacing (by way of grinding, lapping, fining, or other similar procedures) the lens with an abrasive slurry and an oscillating lapping tool. Surfacing is generally defined as the process of creating an optical surface in an ophthalmic lens. Lapping tools are usually cast iron, aluminum, or plastic tools having various lapping surfaces, each of a curvature corresponding to a desired lens curvature. Thus, an optical manufacturer requires a set of lapping tools in order to manufacture lenses of various prescriptions.

Modernly, surfacing pads which conform exactly to the lapping tool curvature are generally used on the surface of each lapping tool. Typically, lenses are also subjected to a polishing procedure. Polishing is generally defined as the process of imparting clarity to an optical lens.

These surfacing pads, sometimes commonly referred to as lapping or polishing pads, usually wear relatively quickly and are generally replaced after a single lens is ground. However, surfacing pads provide a relatively inexpensive surface which will wear instead of the relatively more expensive lapping tool.

Recently, improved surfacing pads have been developed which contain an abrasive material (typically referred to as lapping abrasive), such as, but not limited to, sandpaper or diamond particles, either on the surface of the pad or impregnated into it. Typically, the abrasive content or efficiency of the surfacing pad decreases as grinding progresses to lapping. There is generally very little or even no abrasive content in the surfacing pads employed during the fining and polishing stages.

As an illustration of the differences between surfacing and polishing procedures, glass surfacing involves fining a lens on a cast iron lapping tool, with or without a metal lapping tool pad, with a loose abrasive slurry. Glass polishing, on the other hand, involves polishing a lens on a lapping tool covered with a polishing pad of wool or PELLON™ using a polishing slurry poured over the lapping tool.

One surfacing procedure using such pads involves adhesively attaching a first sandpaper fining pad to a lapping tool and grinding a lens under running water to the proper curve (i.e., the grinding or fining stage). Generally, a second sandpaper fining pad of relatively smaller grit than the first sandpaper surfacing pad is placed over and adhered to the first sandpaper surfacing pad wherein the lens is subjected to a second surfacing step under running water (i.e., the lapping stage). Next, both surfacing pads are removed from the lapping tool, wherein a flocked (e.g., velveteen) polishing pad is adhered to the tool and the lens is polished to a clear finish under a polishing slurry (i.e., the polishing stage). The aforementioned surfacing procedure can be used for both glass and plastic lenses.

Although conventional surfacing pads have aided in the production of optical and ophthalmic lenses, they have certain disadvantages and drawbacks. For example, an operator must frequently attach and remove the surfacing pads which are adhesively secured either to the surface of the lapping tool or to a pad on the surface of the tool and can be difficult to peel off the lapping tool. Frequent removal and reattachment of these surfacing pads may result in the eventual failure of the adhesive to properly hold the surfacing pad in place during the various surfacing operations. Even if the surfacing pads remain in place, the edges of the surfacing pads have the tendency to eventually lift up from the surface of the lapping tool or become damaged by handling, thus affecting the performance of the surfacing pad and leading to surface irregularities and blemishes on the resulting lens. Furthermore, the surfacing pads can be difficult to attach to the tools without the formation of wrinkles, which adversely effect the performance of the surfacing pad. Coolant water flowing over the surfacing pads serves to further increase the difficulties encountered in attaching and removing the surfacing pads.

Therefore, there exists a need for an improved lens surfacing pad and method of attachment therefor which reduces or eliminates these disadvantages and drawbacks. The present invention provides such an improved lens surfacing pad and method of attachment therefor.

Additional objects, advantages, and features of the present invention will become apparent from the following description and appended claims, taken in conjunction with the accompanying drawings.

SUMMARY OF THE INVENTION

In accordance with one embodiment of the present invention, a system for surfacing and polishing optical and ophthalmic lenses is provided, comprising:

- a lapping tool having a curved surface, the curved surface having a magnetic material disposed on at least a portion thereof; and
- a pad, comprising:
  - first and second surfaces being capable of permitting the pad to conform to the curved surface of the lapping tool, the second surface having a metallic material disposed on at least a portion of a surface thereof;
- wherein the metallic material of the second surface adheres to the magnetic material of the curved surface of the lapping tool.

In accordance with another embodiment of the present invention, a system for surfacing and polishing optical and ophthalmic lenses is provided, comprising:

- a lapping tool having a curved surface, the curved surface having a metallic material disposed on at least a portion thereof; and
- a pad, comprising:
  - first and second surfaces being capable of permitting the pad to conform to the curved surface of the lapping tool, the second surface having a magnetic material disposed on at least a portion of a surface thereof;
- wherein the magnetic material of the second surface adheres to the metallic material of the curved surface of the lapping tool.

In accordance with another embodiment of the present invention, a system for surfacing and polishing optical and ophthalmic lenses is provided, comprising:

a lapping tool having a curved surface, the curved surface having a metallic material disposed on at least a portion thereof;

a metallic member disposed within the lapping tool being capable of magnetizing the metallic material of the curved surface of the lapping tool; and a pad, comprising:

first and second surfaces being capable of permitting the pad to conform to the curved surface of the lapping tool, the second surface having a metallic material disposed on at least a portion of a surface thereof;

wherein the metallic material of the second surface adheres to the magnetized metallic material of the curved surface of the lapping tool.

In accordance with another embodiment of the present invention, a pad for use on a curved surface of a lapping tool, the curved surface of the lapping tool having a magnetic material disposed on at least a portion thereof is provided, comprising:

first and second surfaces being capable of permitting the pad to conform to the curved surface of the lapping tool, the second surface having a metallic material disposed on at least a portion of a surface thereof;

wherein the metallic material of the second surface adheres to the magnetic material of the curved surface of the lapping tool.

In accordance with another embodiment of the present invention, a pad for use on a curved surface of a lapping tool is provided, the curved surface of the lapping tool having a metallic material disposed on at least a portion thereof, comprising:

first and second surfaces being capable of permitting the pad to conform to the curved surface of the lapping tool, the second surface having a magnetic material disposed on at least a portion of a surface thereof;

wherein the magnetic material of the second surface adheres to the metallic material of the curved surface of the lapping tool.

In accordance with another embodiment of the present invention, a lapping tool for use with a pad is provided, the lapping tool having a curved surface, the pad having first and second surfaces being capable of permitting the pad to conform to the curved surface of the lapping tool, the second surface having a metallic material disposed on at least a portion of a surface thereof, comprising:

a magnetic material disposed on at least a portion of the curved surface of the lapping tool, the metallic material of the second surface adhering to the magnetic material of the curved surface of the lapping tool.

In accordance with another embodiment of the present invention, a lapping tool for use with a pad is provided, the lapping tool having a curved surface, the pad having first and second surfaces being capable of permitting the pad to conform to the curved surface of the lapping tool, the second surface having a magnetic material disposed on at least a portion of a surface thereof, comprising:

a metallic material disposed on at least a portion of the curved surface of the lapping tool, the magnetic material of the second surface adhering to the metallic material of the curved surface of the lapping tool.

In accordance with another embodiment of the present invention, a method for surfacing and polishing optical and ophthalmic lenses is provided, comprising the steps of:

providing a lapping tool having a curved surface, the curved surface having a magnetic material disposed on at least a portion thereof;

providing a pad, comprising:

first and second surfaces being capable of permitting the pad to conform to the curved surface of the lapping tool, the second surface having a metallic material disposed on at least a portion of a surface thereof;

wherein the metallic material of the second surface adheres to the magnetic material of the curved surface of the lapping tool; and engaging at least a portion of a surface of the lens with the first surface.

In accordance with another embodiment of the present invention, a method for surfacing and polishing optical and ophthalmic lenses is provided, comprising the steps of:

providing a lapping tool having a curved surface, the curved surface having a metallic material disposed on at least a portion thereof;

providing a pad, comprising:

first and second surfaces being capable of permitting the pad to conform to the curved surface of the lapping tool, the second surface having a magnetic material disposed on at least a portion of a surface thereof;

wherein the magnetic material of the second surface adheres to the metallic material of the curved surface of the lapping tool; and engaging at least a portion of a surface of the lens with the first surface.

In accordance with another embodiment of the present invention, a method for surfacing optical and ophthalmic lenses is provided, comprising the steps of:

providing a lapping tool having a curved surface, the curved surface having a metallic material disposed on at least a portion thereof;

providing a metallic member disposed within the lapping tool being capable of magnetizing the metallic material of the curved surface of the lapping tool;

providing a pad, comprising:

first and second surfaces being capable of permitting the pad to conform to the curved surface of the lapping tool, the second surface having a metallic material disposed on at least a portion of a surface thereof;

wherein the metallic material of the second surface adheres to the magnetized metallic material of the curved surface of the lapping tool; and engaging at least a portion of a surface of the lens with the first surface.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of accompanying drawings in which.

The same reference numerals refer to the same parts throughout the various Figures.

DETAILED DESCRIPTION OF THE INVENTION

Figure 1:
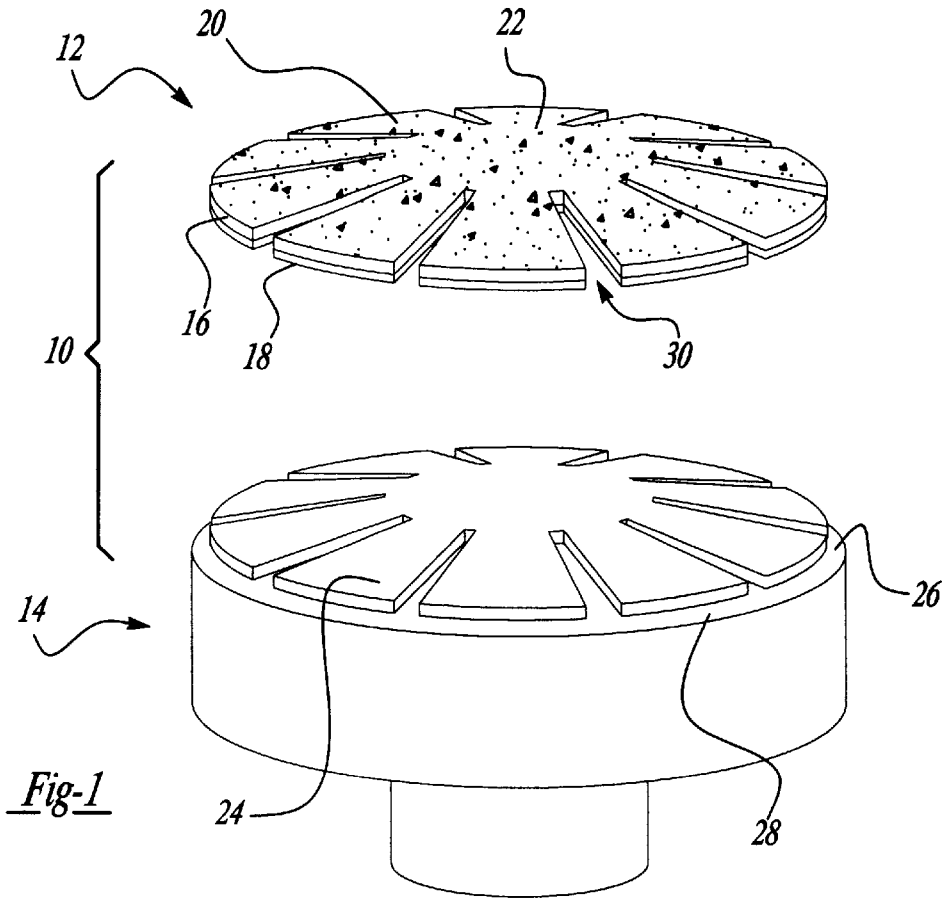
FIG. 1 an exploded view of a system for surfacing optical and ophthalmic lenses, in accordance with one embodiment of the present invention.

Now referring to the drawings, FIGS. 1–4 illustrate a system 10 for surfacing optical and ophthalmic lenses, in accordance with one embodiment of the present invention. The system 10 is comprised primarily of a lens surfacing pad 12 and a lapping tool 14. The term "lens surfacing pad" as used herein, means any type of pad that can be used to either surface and/or polish lenses.

As will be appreciated by those skilled in the art, in use, a blocked lens (not shown) will be oscillated over a surfacing pad 12 in a grinding, lapping, or polishing operation. Additionally, it is also possible to move the surfacing pad 12 relative to the blocked lens during the surfacing or polishing operation.

In accordance with one embodiment of the present invention, the surfacing pad 12 is comprised primarily of a first layer 16 and a second layer 18. Although the surfacing pad 12 is shown as having a "daisy" shaped configuration, it should be noted that other configurations are envisioned in accordance with the general teachings of the present invention. The key consideration is that the surfacing pad 12 is capable of properly engaging the lapping tool 14. However, substantially annular, round, ovoid, and similar configurations are generally preferred.

Preferably, the first layer 16 has a plurality of abrasive particles 20 disposed on and/or within a surface 22 thereof, especially when used for surfacing operations. In this sense, the first layer 16 is considered the operative surface because the surfacing of the lens will be done by this layer. Furthermore, the abrasive particles 20 are considered the operative material because they are performing the actual abrasive function. The abrasive particles 20 may be comprised of sandpaper particles, diamond (e.g., synthetic) particles, or any other suitable type of gritty material. The abrasive particles 20 may be secured to and/or within surface 22 by being disposed on or in a matrix material, such as a metallic matrix material.

With respect to a surfacing pad 12 that is suitable for polishing operations, it will be appreciated that the first surface 16 will have little, if any, abrasive content thereon or therein. For example, a surfacing pad 12 having a first surface 16 without any abrasive contained thereon or therein, may be used in conjunction with a polishing slurry to polish a lens.

The second layer 18 of the surfacing pad 12 is located directly below the first layer 16 and is preferably securely fastened thereto by adhesive, co-extrusion, hot melting, or other suitable methods. Preferably, the second layer 18 has a configuration substantially identical to that of the first layer 16. The second layer 18 is preferably comprised of a metallic material that is capable of adhering to a magnetized material, the significance of which will be explained herein.

Although the surfacing pad 12 has been described as a discrete two layer system, it is envisioned that the surfacing pad 12 can also be comprised of a single layer having a first abrasive surface and a second metallic surface. This can be accomplished by combining an abrasive material (e.g., synthetic diamond) with a metallic material (e.g., iron particles), and forming the two materials into a single layer pad. Thus, one surface of the single layer pad can be used for its abrasive qualities, while the other opposed surface can be used for attachment to the lapping tool 14.

In accordance with one embodiment of the present invention, the lapping tool 14 preferably includes a layer of magnetic material 24 (preferably a permanent magnetic material such as ferromagnetics) disposed on a surface 26 thereof. Additionally, the magnetic material 24 may be dispersed within and throughout the body of the lapping tool 14, as opposed to merely being present on the surface 26.

Preferably, the surface 26 is curved so as to properly engage the curvature of the lens blank. The purpose of the magnetic material 24 is to attract the metallic material of the second layer 18 so as to secure the surfacing pad 12 to the lapping tool 14. It should be noted that the magnetic material 24 should have sufficient magnetic strength to secure the surfacing pad 12 to the lapping tool 14 during grinding, lapping, and polishing operations; however, the magnetic strength should not be so great that the operator can not remove the surfacing pad 12 from the lapping tool 14 relatively easily.

Although the magnetic material 24 is shown as having a "daisy" shaped configuration, it should be noted that other configurations are envisioned in accordance with the general teachings of the present invention. However, it is beneficial if the configuration of the magnetic material 24 is substantially identical to the configuration of the second layer 18 of the surfacing pad 12 so as to fully and efficiently attract the metallic material of the second layer 18. Preferably, the magnetic material 24 should not extend into the margin area 28 of the surface 26 of the lapping tool 14.

In order for the surfacing pad 12 to properly engage the curved surface 26 of the lapping tool 14, the first and second layers 16 and 18, respectively, are provided with at least one radially extending slot member 30 that allows the surfacing pad to flex and thus substantially conform to the curvature of the curved surface 26 of the lapping tool 14.

Figure 2:
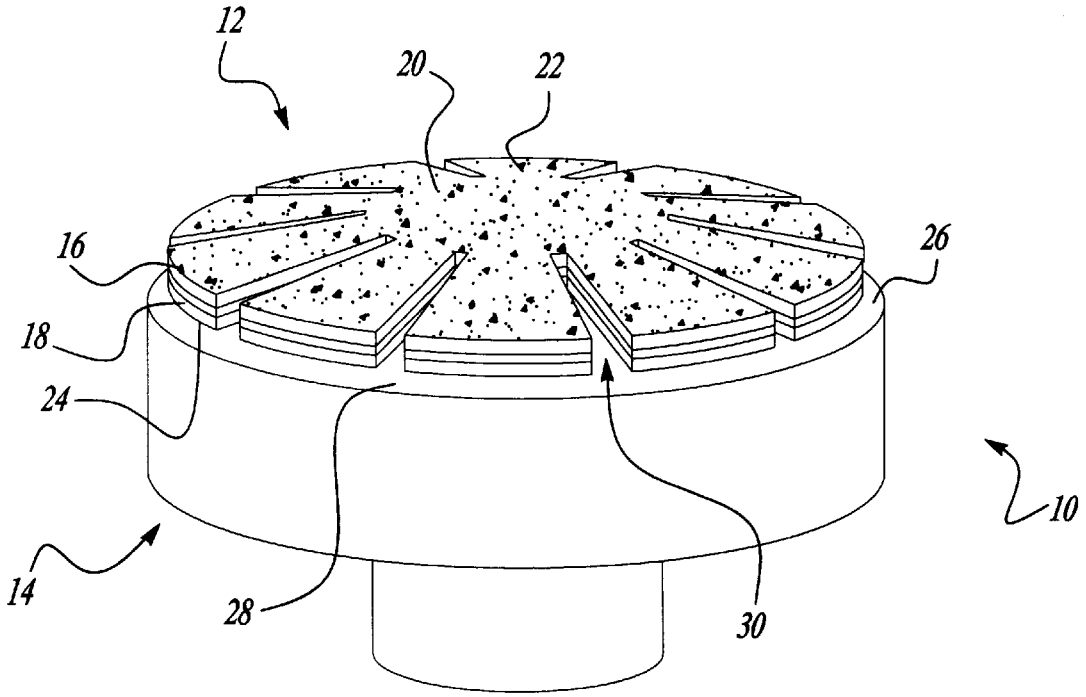
FIG. 2 is a respective view of the system depicted in FIG. 1.

FIG. 2 illustrates a perspective view of the system 10. In this view, the surfacing pad 12 has been placed upon surface 26 of the lapping tool 14. The metallic material of the second layer 16 is attracted to the magnetic material 24 disposed on surface 26 of the lapping tool 14. In this manner, the system 10 is now ready to commence grinding, lapping, and polishing operations.

Figure 3:
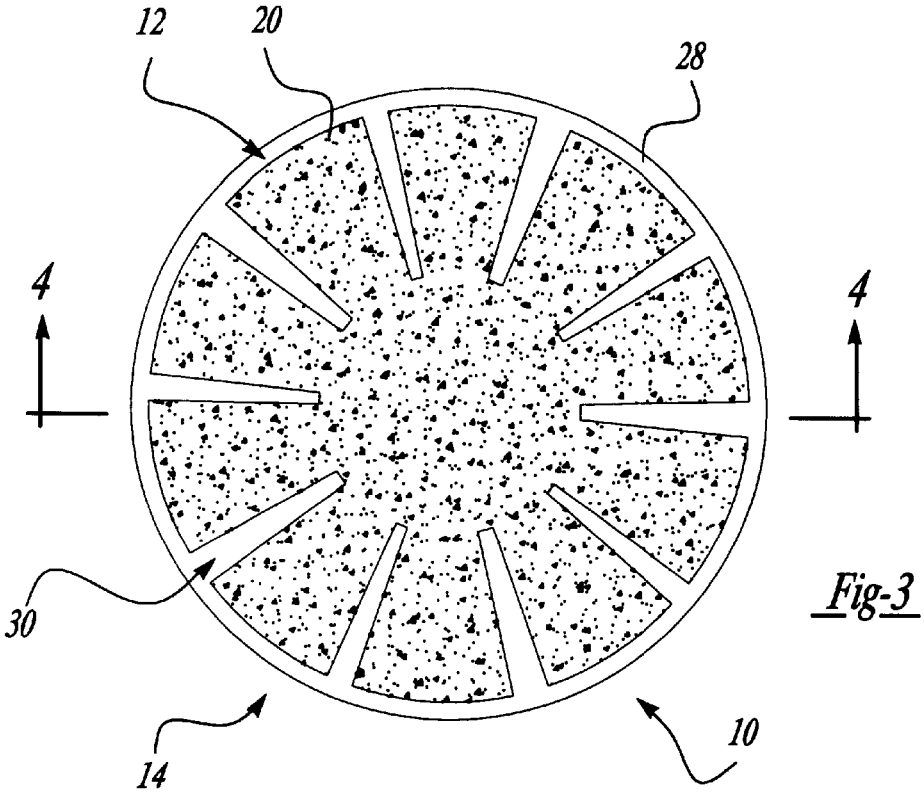
FIG. 3 is a top view of the system depicted in FIG. 2.
Figure 4:
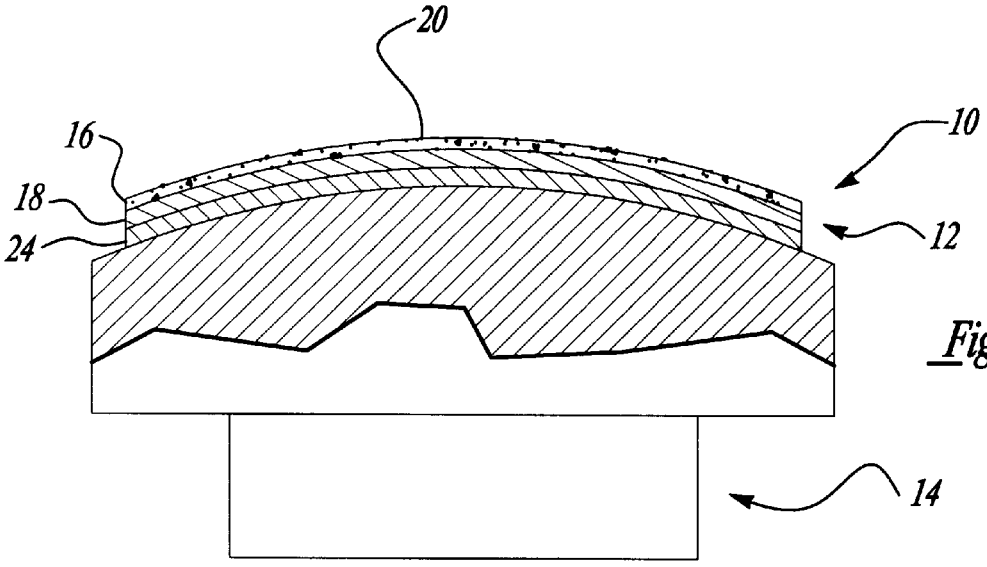
FIG. 4 is a partial sectional view of the system depicted in FIG. 2.

FIG. 3 illustrates a top view of the system 10 and FIG. 4 illustrates a partial sectional view of the system 10 taken along line 4—4 of FIG. 3.

Although the system 10 has been described as having a metallic layer on a surface of the pad that is attracted to a magnetic material on a surface of the lapping tool, it should be noted that both surfaces may have complimentary magnetic materials (i.e., north pole, south pole oriented) disposed on their respective surfaces. In this manner, both respective surfaces will be attracted to each other.

Figure 5:
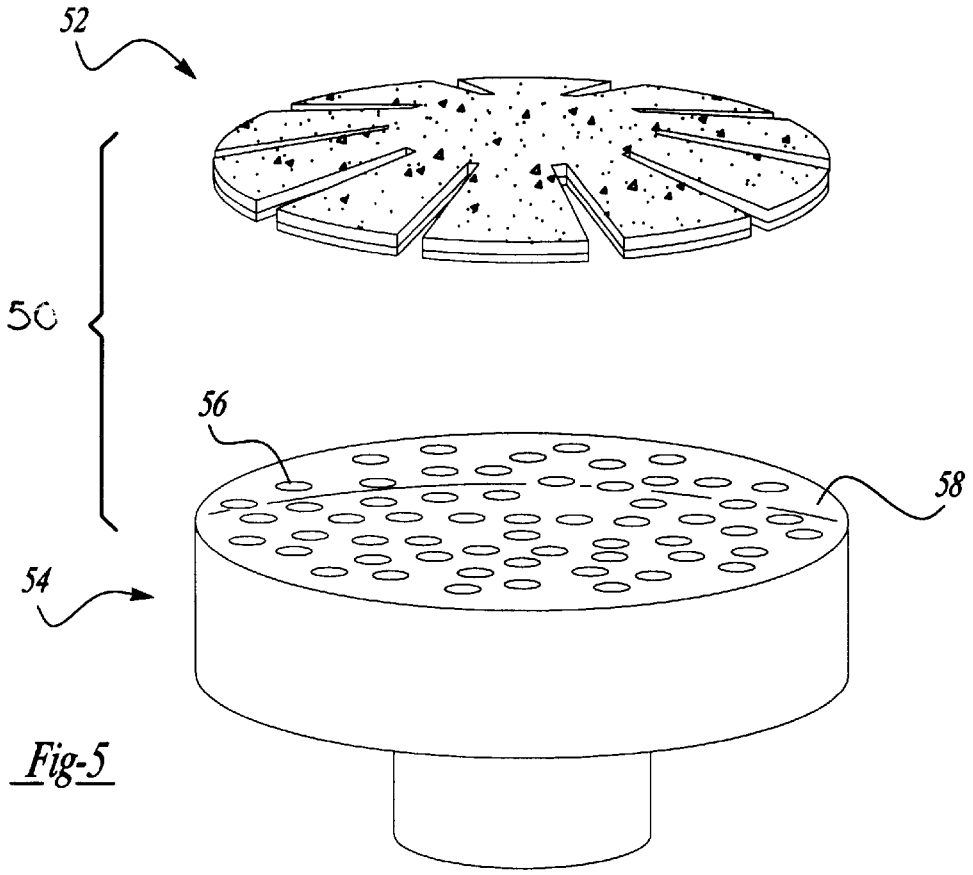
FIG. 5 is an exploded view of a system for surfacing optical and ophthalmic lenses, in accordance with an alternative embodiment of the present invention.

FIG. 5 illustrates a system 50 for surfacing optical and ophthalmic lenses, in accordance with an alternative embodiment of the present invention. The system 50 is comprised primarily of a lens surfacing pad 52 and a lapping tool 54. However, the magnetic material 56 differs from that of the previously described embodiment, in that it is a discontinuous pattern of magnetic material as opposed to a continuous shape (e.g., daisy shape). In this view, the magnetic material 56 is a series of magnetic discs disposed over the surface 58 of the lapping tool 54. However, it should be noted that the magnetic material 56 may be in any number of discontinuous patterns, such as strips, serpentines, curves, coils, lines, particles, and so on.

Figure 6:
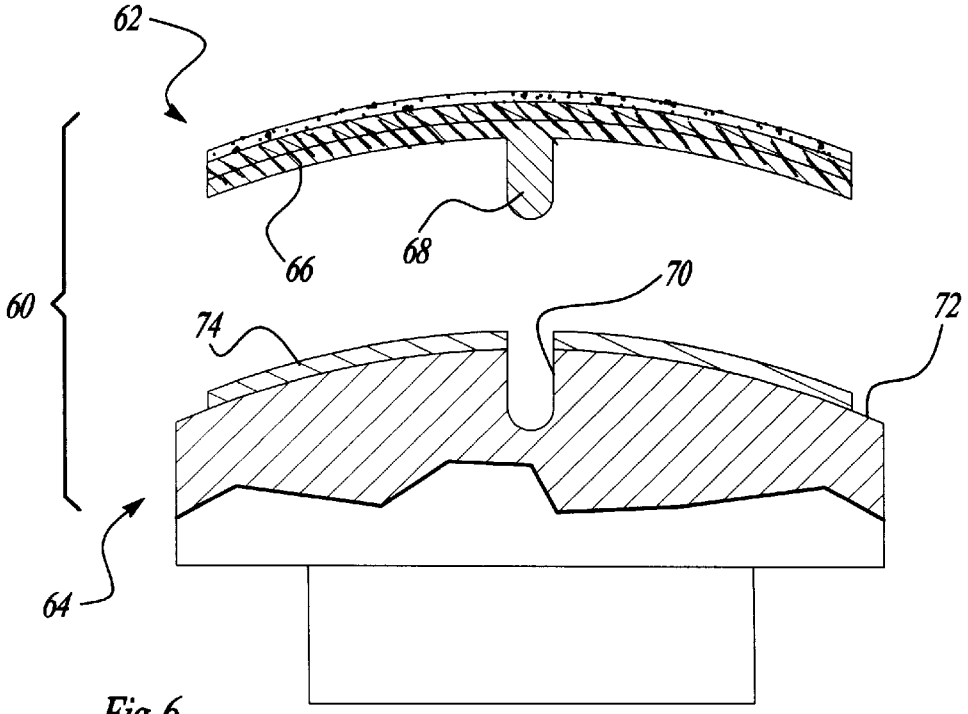
FIG. 6 is a partial exploded sectional view of a system for surfacing optical and ophthalmic lenses, in accordance with an alternative embodiment of the present invention.
Figure 7:
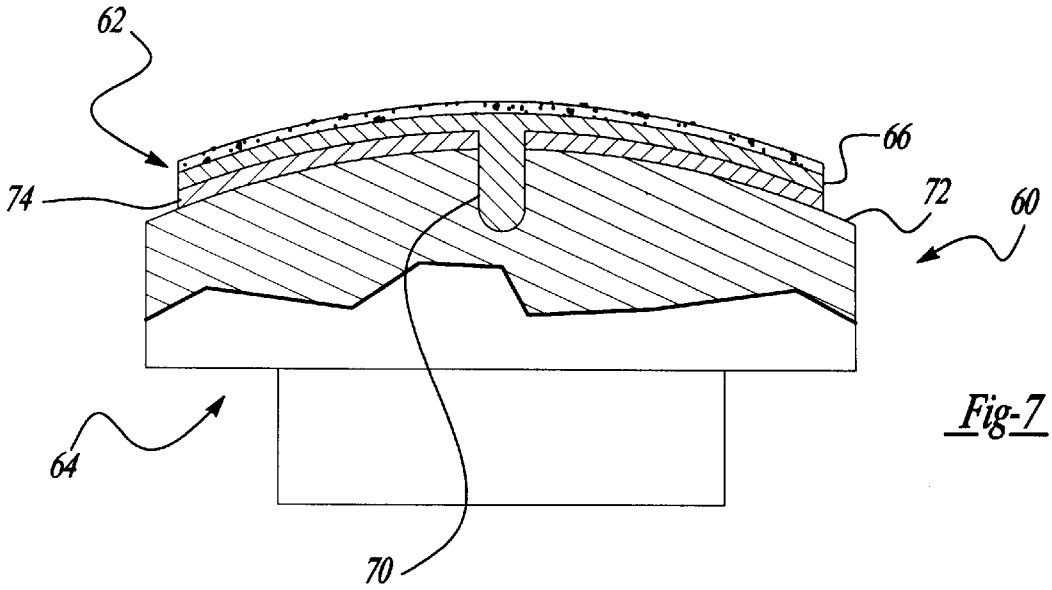
FIG. 7 is a partial sectional view of the system depicted in FIG. 6.

FIGS. 6–7 illustrate a system 60 for surfacing optical and ophthalmic lenses, in accordance with an alternative embodiment of the present invention. The system 60 is comprised primarily of a lens surfacing pad 62 and a lapping tool 64. However, the surfacing pad 62 differs from previously described embodiments in that the second layer 66 has a centrally located projection or member 68, preferably metallic, extending outwardly away from a surface thereof. Additionally, lapping tool 64 differs in that it has a centrally located recess 70 extending below the surface 72 thereof. It should be noted that the magnetic material 74 of the lapping tool 64 does not extend down into the recess 70. It is intended that the member 68 will engage the recess 70 when the surfacing pad 62 is placed upon the lapping tool 64, thus securing the surfacing pad 62 to the lapping tool 64 to a greater extent than the previously described embodiments.

Figure 8:
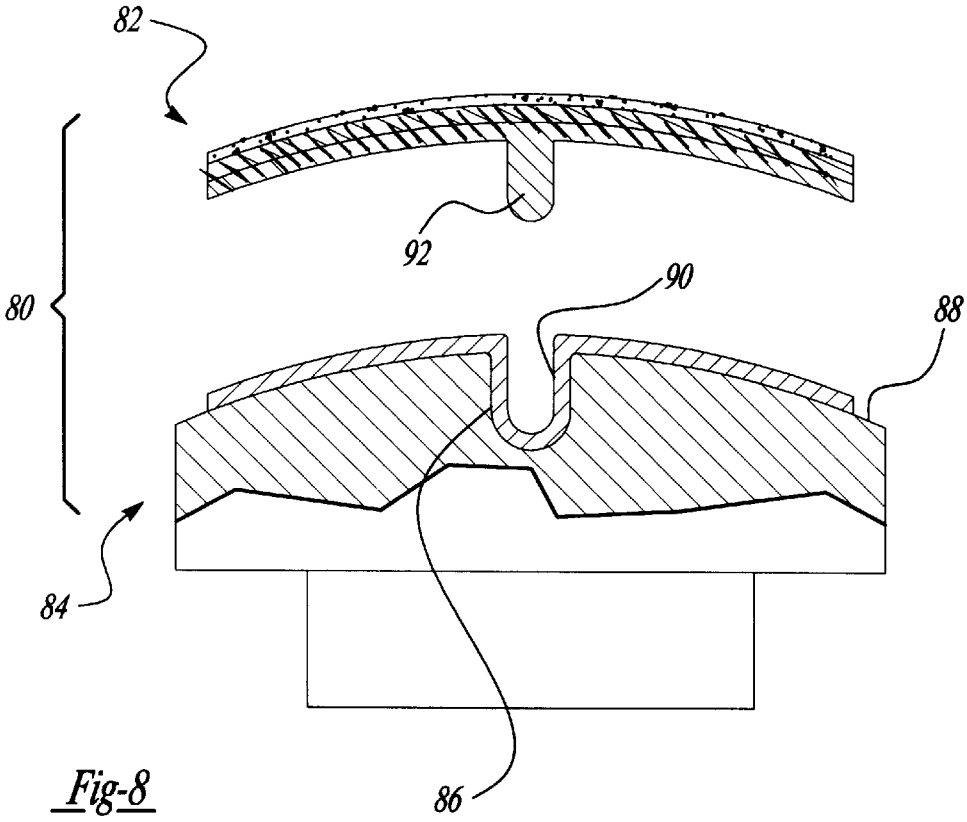
FIG. 8 is a partial exploded sectional view of a system for surfacing optical and ophthalmic lenses, in accordance with an alternative embodiment of the present invention.
Figure 9:
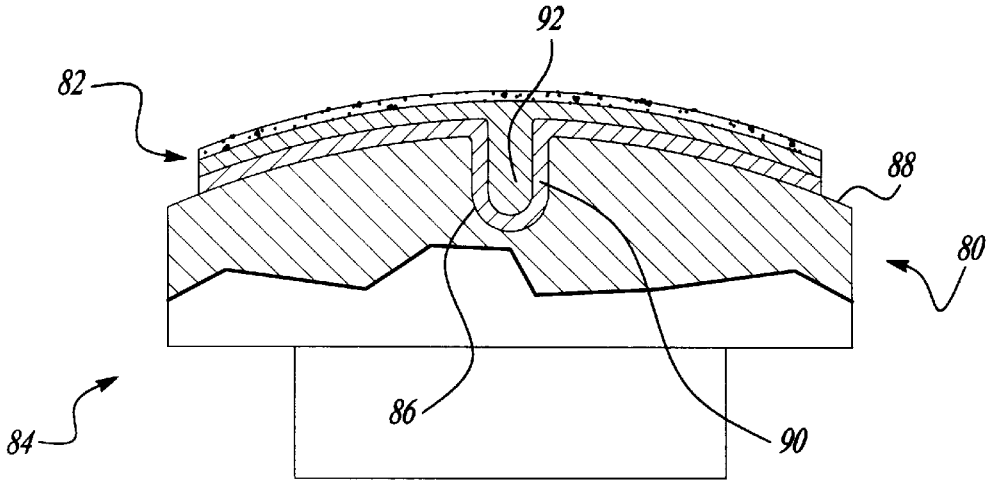
FIG. 9 is a partial view of the system depicted in FIG. 8.

FIGS. 8–9 illustrate a system 80 for surfacing optical and ophthalmic lenses, in accordance with an alternative embodiment of the present invention. The system 80 is comprised primarily of a lens surfacing pad 82 and a lapping tool 84. However, the lapping tool 64 differs in that the centrally located recess 86 which extends below the surface 88 thereof contains a magnetic material 90 disposed about the surface of the recess 86. It is intended that the preferably metallic member 92 will engage the recess 86 when the surfacing pad 82 is placed upon the lapping tool 84, and be attracted to the magnetic material 90 disposed about the surface of the recess 86, thus securing the surfacing pad 82 to the lapping tool 84 to a greater extent than the previously described embodiments.

Although all of the previously described embodiments have described the lapping tool as having a magnetic material disposed on a surface thereof, whereas the surfacing pad has a metallic material disposed on a surface thereof that is attracted to the magnetic material. However, it should be noted that the opposite situation will also work. That is, the surfacing pad may have a surface (e.g., the second or lower surface adjacent to the top surface of the lapping tool) that is magnetic, not merely just metallic, that will attract a metallic, as opposed to a magnetic, surface on the lapping tool.

The previously described embodiments have described the magnetic material as being permanent in nature. However, it is possible to employ a temporary magnetic material as the magnetic material. One example of a temporary magnet is an electromagnet, which consists of a metallic material having an electrically charged wire or coil enveloping it. As the electrical current is applied through the wire, a magnetic field is created about the metallic material. This magnetic metallic material may then induce a magnetic field in an adjacent metallic material, provided that the electrical current continues to flow through the wire. Once the electrical current is discontinued, the magnetic field in the original metallic material will cease to exist, as will the induced magnetic field in the adjacent metallic material.

Figure 10:
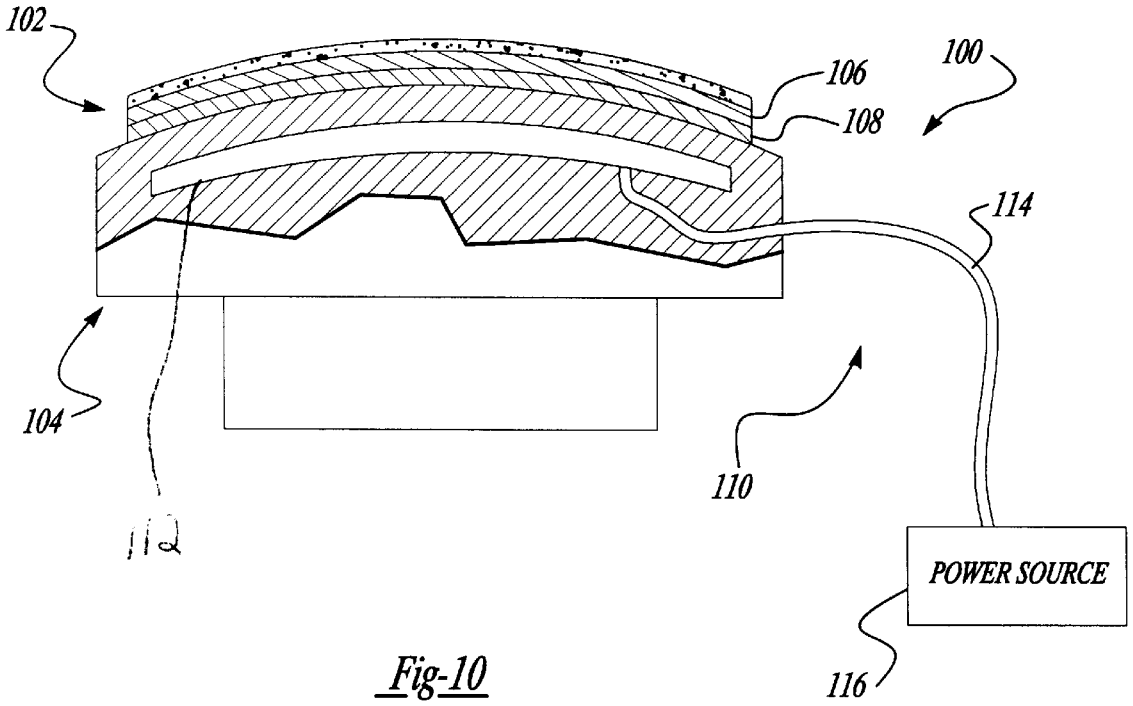
FIG. 10 is a sectional view of a system for surfacing optical and ophthalmic lenses, in accordance with an alternative embodiment of the present invention.

FIG. 10 illustrates a system 100 for surfacing optical and ophthalmic lenses, in accordance with an alternative embodiment of the present invention. The system 100 is comprised primarily of a lens surfacing pad 102 and a lapping tool 104. It should be noted that neither the metallic material of the second layer 106 of the surfacing pad 102, or the metallic material 108 of the lapping tool 104 are magnetized. Therefore, a magnetic field must be generated in order for the metallic material of the second layer 106 of the surfacing pad 102 to be attracted to the metallic material 108 of the lapping tool 104. In order to accomplish this, an electromagnet assembly 110 is provided. The electromagnet assembly 110 consists of a metallic material 112 disposed within the lapping tool 104 adjacent to the metallic material 108 of the lapping tool 104. A wire 114 is wrapped around the metallic material 112 and terminates at a power source 116. As power is applied through the wire 114, a magnetic field is created in the metallic material 112. The magnetic field of the metallic material 112 then induces a magnetic field in the metallic material 108 of the lapping tool 104, thus attracting the metallic material of the second layer 106 of the surfacing pad 102. In this manner, the surfacing pad 102 is secured to the lapping tool 104.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A system for surfacing and polishing optical and ophthalmic lenses, comprising:

a lapping tool having a curved surface, the curved surface having a magnetic material disposed on at least a portion thereof; and a pad, comprising:

first and second surfaces being capable of permitting the pad to conform to the curved surface of the lapping tool, the second surface having a metallic material disposed on at least a portion of a surface thereof;

wherein the metallic material of the second surface adheres to the magnetic material of the curved surface of the lapping tool.

2. The system in accordance with claim 1, wherein the metallic material of the second surface is magnetic.

3. The system in accordance with claim 1, wherein the first and second surfaces have substantially annular configurations.

4. The system in accordance with claim 1, wherein the first surface includes an abrasive material disposed on at least a portion of a surface thereof.

5. The system in accordance with claim 1, wherein the first surface includes at least one radially extending slot.

6. The system in accordance with claim 1, wherein the second surface includes at least one radially extending slot.

7. The system in accordance with claim 1, wherein the lapping tool includes a recess extending below the curved surface, the second surface includes a projection extending therefrom, the projection of the second surface engaging the recess of the lapping tool.

8. The system in accordance with claim 7, wherein the recess includes a magnetic material disposed on at least a portion of a surface thereof.

9. A system for surfacing and polishing optical and ophthalmic lenses, comprising:

a lapping tool having a curved surface, the curved surface having a metallic material disposed on at least a portion thereof; and a pad, comprising:

first and second surfaces being capable of permitting the pad to conform to the curved surface of the lapping tool, the second surface having a magnetic material disposed on at least a portion of a surface thereof;

wherein the magnetic material of the second surface adheres to the metallic material of the curved surface of the lapping tool.

10. The system in accordance with claim 9, wherein the metallic material of the curved surface of the lapping tool is magnetic.

11. The system in accordance with claim 9, wherein the first and second surfaces have substantially annular configurations.

12. The system in accordance with claim 9, wherein the first surface includes an abrasive material disposed on at least a portion of a surface thereof.

13. The system in accordance with claim 9, wherein the first surface includes at least one radially extending slot.

14. The system in accordance with claim 9, wherein the second surface includes at least one radially extending slot.

15. The system in accordance with claim 9, wherein the lapping tool further includes a recess extending below the curved surface, the second surface includes a projection extending therefrom, the projection of the second surface engaging the recess of the lapping tool.

16. The system in accordance with claim 15, wherein the recess includes a metallic material disposed on at least a portion of a surface thereof.

17. A system for surfacing and polishing optical and ophthalmic lenses, comprising:

a lapping tool having a curved surface, the curved surface having a metallic material disposed on at least a portion thereof;

a metallic member disposed within the lapping tool being capable of magnetizing the metallic material of the curved surface of the lapping tool; and a pad, comprising:

first and second surfaces being capable of permitting the pad to conform to the curved surface of the lapping tool, the second surface having a metallic material disposed on at least a portion of a surface thereof;

wherein the metallic material of the second surface adheres to the magnetized metallic material of the curved surface of the lapping tool.

18. The system in accordance with claim 17, wherein the metallic material of the second surface is magnetic.

19. The system in accordance with claim 17, wherein the first and second surfaces have substantially annular configurations.

20. The system according to claim 17, wherein the first surface includes an abrasive material disposed on at least a portion of a surface thereof.

21. The system in accordance with claim 17, wherein the first surface includes at least one radially extending slot.

22. The system in accordance with claim 17, wherein the second surface includes at least one radially extending slot.

23. The system in accordance with claim 17, wherein the lapping tool includes a recess extending below the curved surface, the second surface includes a projection extending therefrom, the projection of the second surface engaging the recess of the lapping tool.

24. The system in accordance with claim 23, wherein the recess includes a metallic material disposed on at least a portion of a surface thereof.

25. A pad for use on a curved surface of a lapping tool, the curved surface of the lapping tool having a magnetic material disposed on at least a portion thereof, comprising:

first and second surfaces being capable of permitting the pad to conform to the curved surface of the lapping tool, the second surface having a metallic material disposed on at least a portion of a surface thereof;

wherein the metallic material of the second surface adheres to the magnetic material of the curved surface of the lapping tool.

26. The pad in accordance with claim 25, wherein the metallic material of the second surface is magnetic.

27. The pad in accordance with claim 25, wherein the first and second surfaces have substantially annular configurations.

28. The pad in accordance with claim 25, wherein the first surface includes an abrasive material disposed on at least a portion of a surface thereof.

29. The pad in accordance with claim 25, wherein the first surface includes at least one radially extending slot.

30. The pad in accordance with claim 25, wherein the second surface includes at least one radially extending slot.

31. The pad in accordance with claim 25, wherein the lapping tool includes a recess extending below the curved surface, the second surface includes a projection extending therefrom, the projection of the second surface engaging the recess of the lapping tool.

32. The pad in accordance with claim 31, wherein the recess includes a magnetic material disposed on at least a portion of a surface thereof.

33. A pad for use on a curved surface of a lapping tool, the curved surface of the lapping tool having a metallic material disposed on at least a portion thereof, comprising:

first and second surfaces being capable of permitting the pad to conform to the curved surface of the lapping tool, the second surface having a magnetic material disposed on at least a portion of a surface thereof;

wherein the magnetic material of the second surface adheres to the metallic material of the curved surface of the lapping tool.

34. The pad in accordance with claim 33, wherein the metallic material of the curved surface of the lapping tool is magnetic.

35. The pad in accordance with claim 33, wherein the first and second surfaces have substantially annular configurations.

36. The pad in accordance with claim 33, wherein the first surface includes an abrasive material disposed on at least a portion of a surface thereof.

37. The pad in accordance with claim 33, wherein the first surface includes at least one radially extending slot.

38. The pad in accordance with claim 33, wherein the second surface includes at least one radially extending slot.

39. The pad in accordance with claim 33, wherein the lapping tool includes a recess extending below the curved surface, the second surface includes a projection extending therefrom, the projection of the second surface engaging the recess of the lapping tool.

40. The pad in accordance with claim 39, wherein the recess includes a metallic material disposed on at least a portion of a surface thereof.

41. A lapping tool for use with a pad, the lapping tool having a curved surface, the pad having first and second surfaces being capable of permitting the pad to conform to the curved surface of the lapping tool, the second surface having a metallic material disposed on at least a portion of a surface thereof, comprising:

a magnetic material disposed on at least a portion of the curved surface of the lapping tool, the metallic material of the second surface adhering to the magnetic material of the curved surface of the lapping tool.

42. The lapping tool in accordance with claim 41, wherein the metallic material of the second surface is magnetic.

43. The lapping tool in accordance with claim 41, wherein the first and second surfaces have substantially annular configurations.

44. The lapping tool in accordance with claim 41, wherein the first surface includes an abrasive material disposed on at least a portion of a surface thereof.

45. The lapping tool in accordance with claim 41, wherein the first surface includes at least one radially extending slot.

46. The lapping tool in accordance with claim 41, wherein the second surface includes at least one radially extending slot.

47. The lapping tool in accordance with claim 41, wherein the lapping tool includes a recess extending below the curved surface, the second surface includes a projection extending therefrom, the projection of the second surface engaging the recess of the lapping tool.

48. The lapping tool in accordance with claim 47, wherein the recess includes a magnetic material disposed on at least a portion of a surface thereof.

49. A lapping tool for use with a pad, the lapping tool having a curved surface, the pad having first and second surfaces being capable of permitting the pad to conform to the curved surface of the lapping tool, the second surface having a magnetic material disposed on at least a portion of a surface thereof, comprising:

a metallic material disposed on at least a portion of the curved surface of the lapping tool, the magnetic material of the second surface adhering to the metallic material of the curved surface of the lapping tool.

50. The lapping tool in accordance with claim 49, wherein the metallic material of the curved surface of the lapping tool is magnetic.

51. The lapping tool in accordance with claim 49, wherein the first and second surfaces have substantially annular configurations.

52. The lapping tool in accordance with claim 49, wherein the first surface includes an abrasive material disposed on at least a portion of a surface thereof.

53. The lapping tool in accordance with claim 49, wherein the first surface includes at least one radially extending slot.

54. The lapping tool in accordance with claim 49, wherein the second surface includes a t least one radially extending slot.

55. The lapping tool in accordance with claim 49, wherein the lapping tool includes a recess extending below the curved surface, the second surface includes a projection extending therefrom, the projection of the second surface engaging the recess of the lapping tool.

56. The lapping tool in accordance with claim 55, wherein the recess includes a magnetic material disposed on at least a portion of a surface thereof.

57. A method for surfacing and polishing optical and ophthalmic lenses, comprising the steps of:

providing a lapping tool having a curved surface, the curved surface having a magnetic material disposed on at least a portion thereof;

providing a pad, comprising:

first and second surfaces being capable of permitting the pad to conform to the curved surface of the lapping tool, the second surface having a metallic material disposed on at least a portion of a surface thereof;

wherein the metallic material of the second surface adheres to the magnetic material of the curved surface of the lapping tool; and engaging at least a portion of a surface of the lens with the first surface.

58. The method in accordance with claim 57, wherein the metallic material of the second surface is magnetic.

59. The method in accordance with claim 57, wherein the first and second surfaces have substantially annular configurations.

60. The method in accordance with claim 57, wherein the first surface includes an abrasive material disposed on at least a portion of a surface thereof.

61. The method in accordance with claim 57, further comprising the step of moving the lens relative to the surfacing pad.

62. The method in accordance with claim 57, further comprising the step of moving the surfacing pad relative to the lens.

63. A method for surfacing and polishing optical and ophthalmic lenses, comprising the steps of:

providing a lapping tool having a curved surface, the curved surface having a metallic material disposed on at least a portion thereof;

providing a pad, comprising:

first and second surfaces being capable of permitting the pad to conform to the curved surface of the lapping tool, the second surface having a magnetic material disposed on at least a portion of a surface thereof;

wherein the magnetic material of the second surface adheres to the metallic material of the curved surface of the lapping tool; and engaging at least a portion of a surface of the lens with the first surface.

64. The method in accordance with claim 63, wherein the metallic material of the curved surface of the lapping tool is magnetic.

65. The method in accordance with claim 63, wherein the first and second surfaces have substantially annular configurations.

66. The method in accordance with claim 63, wherein the first surface includes an abrasive material disposed on at least a portion of a surface thereof.

67. The method in accordance with claim 63, further comprising the step of moving the lens relative to the surfacing pad.

68. The method in accordance with claim 63, further comprising the step of moving the surfacing pad relative to the lens.

69. A method for surfacing optical and ophthalmic lenses, comprising the steps of:

providing a lapping tool having a curved surface, the curved surface having a metallic material disposed on at least a portion thereof;

providing a metallic member disposed within the lapping tool being capable of magnetizing the metallic material of the curved surface of the lapping tool;

providing a pad, comprising:

first and second surfaces being capable of permitting the pad to conform to the curved surface of the lapping tool, the second surface having a metallic material disposed on at least a portion of a surface thereof;

wherein the metallic material of the second surface adheres to the magnetized metallic material of the curved surface of the lapping tool; and engaging at least a portion of a surface of the lens with the first surface.

70. The method in accordance with claim 69, wherein the metallic material of the second surface is magnetic.

71. The method in accordance with claim 69, wherein the first and second surfaces have substantially annular configurations.

72. The method in accordance with claim 69, wherein the first surface includes an abrasive material disposed on at least a portion of a surface thereof.

73. The method in accordance with claim 69, further comprising the step of moving the lens relative to the surfacing pad.

74. The method in accordance with claim 69, further comprising the step of moving the surfacing pad relative to the lens.

* * * * *